United States Patent [19]

Wheeler

[11] 4,377,957

[45] Mar. 29, 1983

[54] JOINED BLANKING TOOL

[75] Inventor: Warren H. Wheeler, Seattle, Wash.

[73] Assignee: The Boeing Company, Seattle, Wash.

[21] Appl. No.: 165,916

[22] Filed: Jul. 3, 1980

[51] Int. Cl.[3] ..... B26F 1/00

[52] U.S. Cl. ..... 83/103; 83/588; 83/637; 83/685; 83/698

[58] Field of Search ..... 269/99, 138, 234; 72/446, 448, 465, 470; 83/103, 588, 699–670, 684, 685, 686, 698, 637

[56] References Cited

U.S. PATENT DOCUMENTS

| | | | |
|---|---|---|---|
| 237,610 | 2/1881 | Scherb | 72/46.5 |
| 412,618 | 10/1889 | Holz | 83/103 |
| 958,459 | 5/1910 | Ames | 83/698 |
| 2,587,025 | 2/1952 | Beck et al. | 269/234 |
| 3,186,284 | 6/1965 | Bennett | 83/685 |
| 3,194,096 | 7/1965 | Comet | 83/103 |
| 3,345,896 | 10/1967 | Bennett | 83/637 |
| 3,568,555 | 3/1971 | Stroh | 83/588 |
| 3,610,021 | 10/1971 | Hopper | 72/446 |
| 3,777,601 | 12/1973 | Strandell | 83/685 |

*Primary Examiner*—James L. Jones, Jr.
*Assistant Examiner*—K. Bradford Adolphson
*Attorney, Agent, or Firm*—Morris A. Case; Bernard A. Donahue

[57] ABSTRACT

The blanking tool has a pair of plates, one of which supports a punch and the other has a mating die cavity. The two plates are resiliently joined together to permit limited reciprocal movement. One of the two joined plates has provisions for mounting to a platen of a punch press.

1 Claim, 3 Drawing Figures

JOINED BLANKING TOOL

BACKGROUND OF THE INVENTION

Blanking tools are presently used in conjunction with a press plate holder which has a standard tapped hole pattern. This hole pattern is jig drilled into the backing plate of the blanking tools to provide for alignment of the punch and die when they are fastened to the upper and lower half of the press plate holder. Since this standard hole pattern is repeated at regular intervals to accommodate several sizes of blanking tools, operator care is required to assure that the matching hole pattern is used on both the upper and lower faces of the press plate holder. Attaching the blanking tool to the press plate holder is a relatively time consuming operation and requires that the operator observe all safety standards since it is a "hands in die area" operation. After attaching the blanking tool to the holder, the press stroke must be adjusted to provide for proper entrance of the punch into the die. Since the two halves of the blanking tool are fastened to the press platen and the press ram, the open distance will be equal to the press stroke length of the particular press it is being used in, generally four inches or more. This is also a requirement to allow the operator to reach in and remove the part from the scrap skeleton; another "hands in die area" operation.

SUMMARY OF THE INVENTION

A blanking tool that has a punch mounted to a plate and a matching die cavity mounted to a second plate. Leader pins extend between the two plates to align them. The plates are joined together in a manner to permit limited reciprocal movement. One of the plates is mounted to the platen of a punch press for actuation of the blanking tool and the plates are resiliently held apart to permit introduction of feed stock.

It is an object of this invention to provide a blanking tool that may be quickly mounted to a press.

It is another object of this invention to provide blanking tools that may be quickly changed in a press with limited opening to prevent "hands in press" type of operation.

It is yet another object of this invention to provide a blanking tool that is compatible with automatic feed systems.

DETAILED DESCRIPTION

Figure 1:
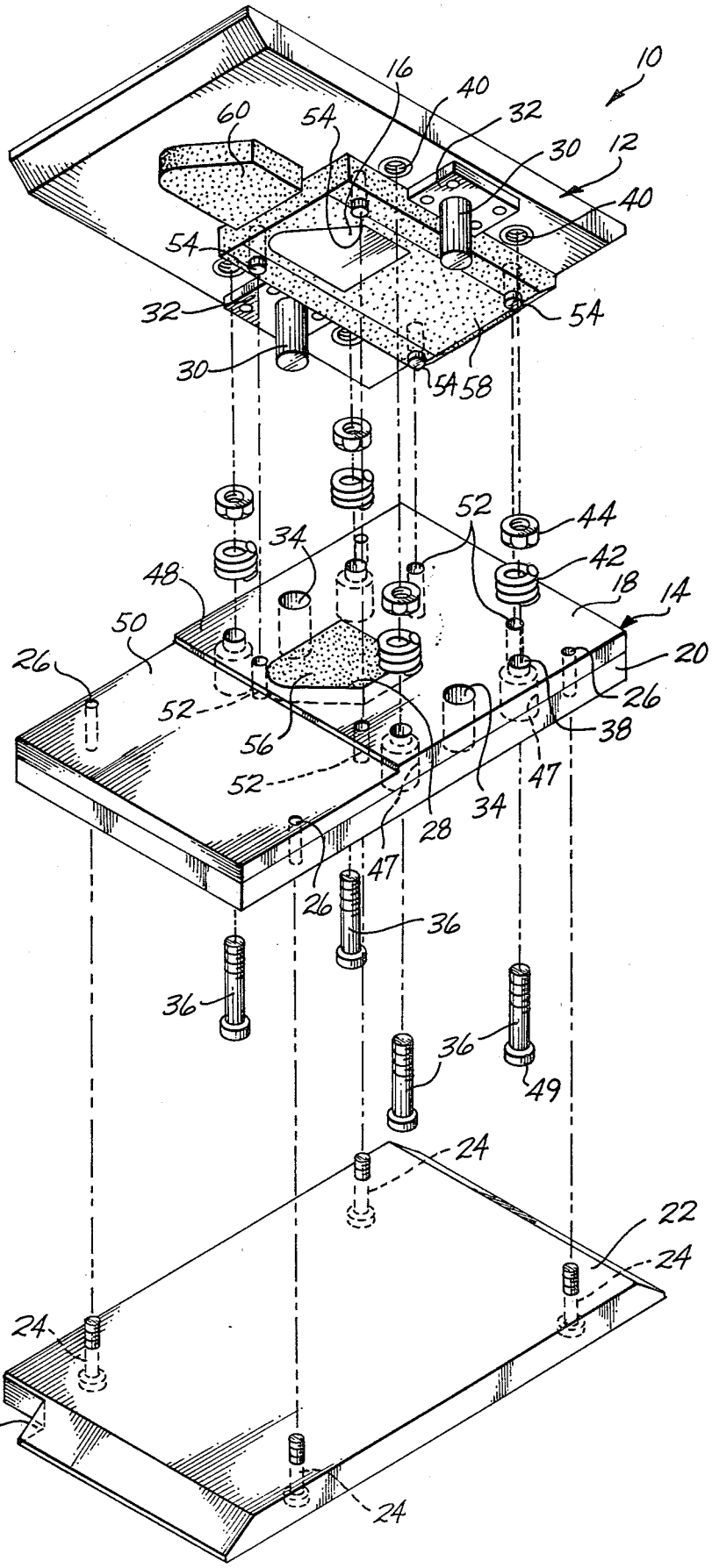
FIG. 1 shows an exploded perspective view of the blanking tool of this invention.

The blanking tool 10 is made with an upper plate 12 and a lower plate assembly 14. Located in the center of the upper plate is a punch 16 shaped to give configuration to a punched part. The lower plate assembly 14 has major parts of a die plate 18, a shim 20, and a base plate 22. Members of the lower plate assembly are joined together by bolts 24 screwing into threads 26 located in the die plate. Located in the die plate, is a die cavity 28 shaped to match die 16. The upper and lower plates are aligned with leader pins 30. Those pins located in hold down members 32 enter into openings 34 located in the lower plate assembly to assure proper alignment of the punch in the die cavity.

Figure 2:
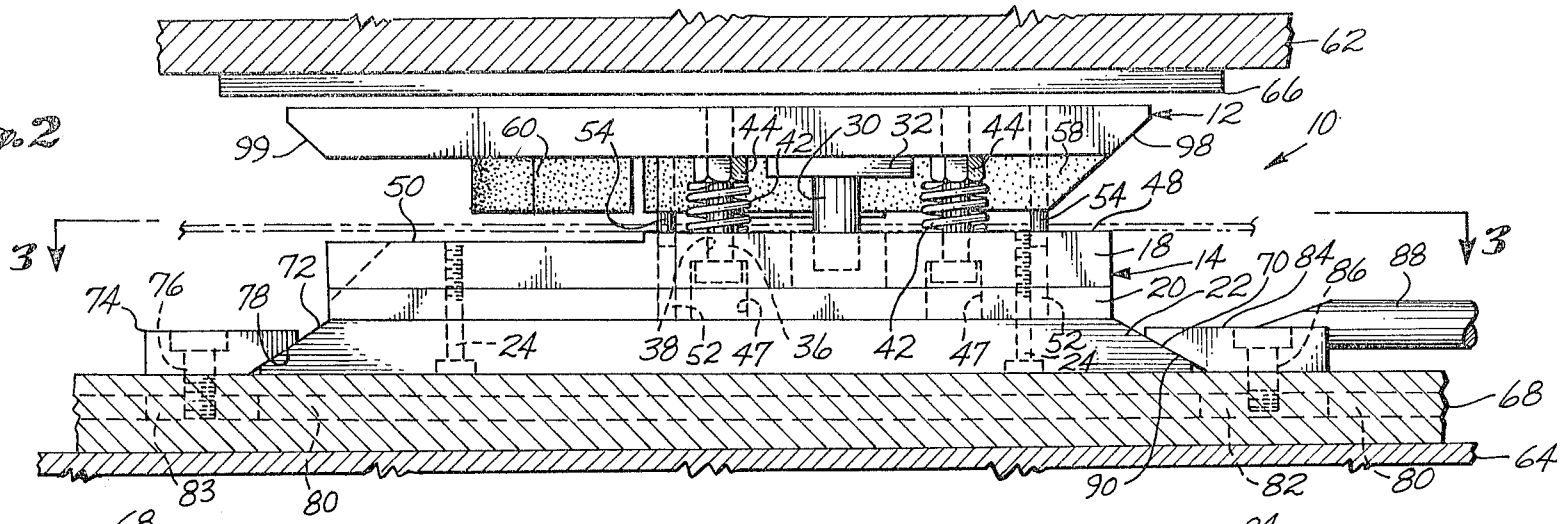
FIG. 2 shows a side elevational view of the blanking tool of FIG. 1 mounted in a press.
Figure 3:
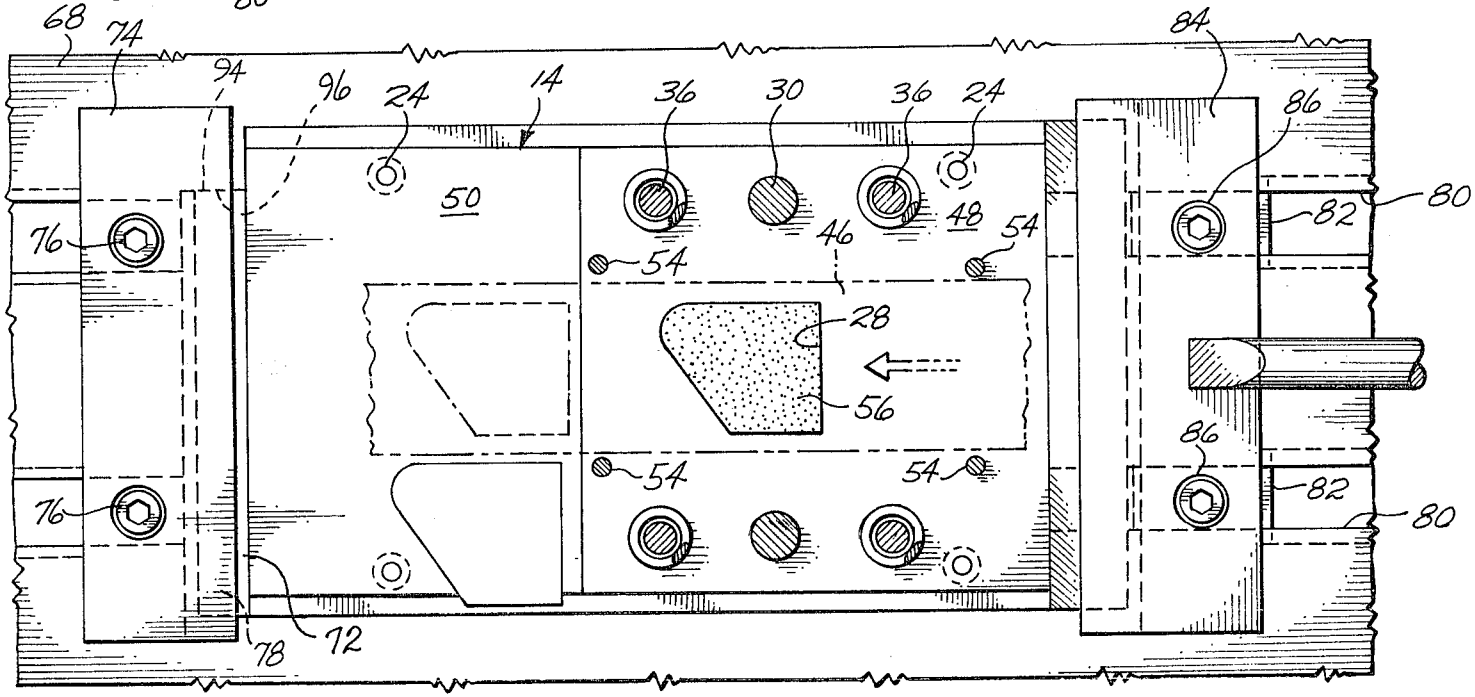
FIG. 3 shows a sectional view taken along lines 3—3 of FIG. 2.

The upper plate and the lower plate assembly are also joined together. This is accomplished with bolts 36 extending through openings 38 in the shim and die plate, and on up into a threaded opening 40 in the upper plate. Compression springs 42 and nuts 44 are also located on these bolts. The springs provide a resiliency forcing the plates apart to permit stock strip 46 to be inserted between the plates. The nuts 44 are used to control the spacing between the plates, and an enlarged opening 47 in the die plate permits the head 49 to move and allow the punch to be moved into the die cavity. The die cavity 28 of the die plate is located on surface 48, and the die plate also has a stepped down surface 50. The die plate also has a series of openings 52 extending therethrough. These openings are used in combination with pins 54 on the upper plate to act as guide strips for feed stock 46. The die cavity is filled with stripping material 56 to push a punched part back out of the cavity. Stripping material 58 is located around the punch 16 in the upper die 12 and a shaped piece of stripper material 60 is also located on the upper plate in a position to press a punched piece out of the feed stock and onto the stepped down surface 50. In the preferred embodiment, distance between the upper and lower plates are adjusted with surface 48 and punch 16 separated by one and one-half times the feed stock thickness. This forces the stripper in the die cavity to return the punched part into the opening in the feed stock and remain there until the stock is moved over the stepped down part of the die plate. In this location, the shaped stripper material in the upper plate forces the part onto surface 50 where it can be removed with air or other known means. The joined blanking tool may be quickly mounted to a punch press. FIG. 2 shows an upper platen 62 and a lower platen 64 of a punch press which is not shown. That figure shows a bolster 66 mounted to the upper platen and lower bolster 68 mounted to the lower platen.

The die plate 22 has an outwardly extending beveled surface 70 at the leading edge and an outwardly extended beveled surface 72 at the trailing edge. A clamp bar 74 is bolted to bolster 68 with bolts 76. This clamp bar has an inwardly beveled surface 78 to match the surface 72 on the base plate. There are two parallel, lengthwise extending, "T" slots 80 located in the bolster 68. Guide bars 82 and 83 are located in the "T" slots and are free to move back and forth in these slots. The clamp bar 74 is joined by the bolts 76 to the guide bars 83 in a manner to lock the clamp bar to the bolster in a fixed position that can be relocated by loosening the bolts, moving the clamp and guide bars and retightening the bolts to secure the clamp bar in the new location. A clamp bar 84 is joined to the guide bars 82 with bolts 86 in a manner to permit the clamp bar to be moved reciprocally while remaining attached to the bolster. A rod 88 is joined to clamp bar 84 and the other end of the rod is fastened to a cylinder, not shown, that is used to move the clamp bar back and forth. The clamp bar has an inwardly extending beveled surface 90 to match beveled surface 70 on the base plate. When the clamp bar 84 is moved forward against the base plate it secures the base plate and thus, the blanking tool, between the two clamp bars. A corner of the base plate is cut off square at location 92. This acts as an index to control the distance from surfaces 94 in that cutaway and the center line of the blanking tool. The clamp bar 74 has the beveled surface 78 terminated along a square surface 96. This surface acts as a stop to coact with surface 94 on the base plate to provide for lateral indexing of the blanking tool.

For the purpose of saving time when changing from one blanking tool to another, it is preferable to have the press adjusted at a common shut height. The shim 20 permits the entry of various blanking tools with different thickness of feed stock while using a common press height. This blanking tool also permits using a height of press openings which will have an opening between the blanking tool and the press that is limited in amount such that an operator cannot insert a finger in the press area where they could become injured.

In operation, the press is first adjusted to the proper opening. Next, the distance between surface 48, of the die plate and punch 16, in the upper plate is adjusted to the proper distance by use of bolts 36 and the nuts 44 lock it in position. The blanking tool is then placed on bolster 68 and moved laterally until surface 94 of the base plate 22 is against stop 96. The actuating cylinder is then operated to move clamp 84 against the base plate and press the base plate over against clamp 74 so that the blanking tool is now secured between the two clamps. The feed stock 46 is then introduced passing between guide pins 54 and under the punch 16. The feed stock is then advanced placing material under the punch and dropping the punched part out onto surface 50 of the die plate where it is removed by use of compressed air.

With this blanking tool it is only necessary to clamp a blanking tool to one of the platens on a punch press. In the preferred embodiment, as shown, the blanking tool was joined to the lower platen on the press. However, it is not intended to limit this joining to the lower platen as this blanking tool could be joined to the upper platen only by using the clamping means shown on the lower bolster on the upper bolster instead and clamping to beveled surfaces 98 and 99 on the plate to which the punch is attached.

I claim:

1. A blanking tool comprising: a punch mounted on a punch backing plate, a mating die cavity as part of a die plate, leader pins aligning the two plates, bolts joining the aligned plates, compression springs urging the joined plates apart to permit the introduction of feed stock, a bolster fastened to a platen of a punch press, the base of the die plate having two opposite ends each beveled outward with the first end having a laterally extending recess that acts as an indexing notch, a first clamp bar adjustably fastened to the bolster of the press with the clamp bar beveled to match the first beveled end of the die plate and having a stop to act as a lateral indexing unit in conjunction with the recess to centrally align the blanking tool on the bolster, a second clamp bar beveled to match the second beveled end on the die plate, means secured to the second clamp bar for moving that bar forward against the beveled side of the die plate to hold the blanking tool to the bolster, the die plate having a stripper material filling the die cavity, a stepped down surface away from the die cavity and feed stock guide pins; the punch plate has stripper material around the punch and a shaped stripper part located above the stepped down part of the die plate; and the bolts adjusted to restrict the upward travel of the punch such that the clearance between the punch and die is less than two thicknesses of material to be punched.

* * * * *